US006374647B1

(12) United States Patent
Holmgren

(10) Patent No.: US 6,374,647 B1
(45) Date of Patent: Apr. 23, 2002

(54) ANTI-THEFT DEVICE FOR SPECTACLE FRAMES

(75) Inventor: Bertil Holmgren, Vellinge (SE)

(73) Assignee: MW Trading APX, Roslev (DK)

( * ) Notice: Subject to any disclaimer, the term of this patent is extended or adjusted under 35 U.S.C. 154(b) by 0 days.

(21) Appl. No.: 09/555,500

(22) PCT Filed: Dec. 15, 1998

(86) PCT No.: PCT/SE98/02303

§ 371 Date: Jul. 25, 2000

§ 102(e) Date: Jul. 25, 2000

(87) PCT Pub. No.: WO99/36653

PCT Pub. Date: Jul. 22, 1999

(30) Foreign Application Priority Data

Dec. 30, 1997 (SE) ..... 9704907

(51) Int. Cl.[7] ..... E05B 65/00

(52) U.S. Cl. ..... 70/57.1; 206/807; 24/704.1; 292/307 R

(58) Field of Search ..... 70/14, 57.1–59; 292/307 R; 206/807; 24/704.1

(56) References Cited

U.S. PATENT DOCUMENTS

| | | | | |
|---|---|---|---|---|
| 4,106,801 A | * | 8/1978 | De Lima Castro Neto | 292/307 R |
| 4,819,797 A | | 4/1989 | Holmgren | 206/309 |
| D313,412 S | | 1/1991 | Holmgren | D14/120 |
| 5,119,652 A | * | 6/1992 | Costa | 70/57.1 |
| 5,144,820 A | | 9/1992 | Holmgren | 70/57.1 |
| 5,368,162 A | | 11/1994 | Holmgren | 206/387 |
| 5,437,172 A | * | 8/1995 | Lamy et al. | 70/57.1 |
| 5,468,031 A | | 11/1995 | Holmgren | 297/81 |
| 5,524,463 A | * | 6/1996 | Schenkel et al. | 70/57.1 |
| 5,588,315 A | | 12/1996 | Holmgren | 70/57.1 |
| 5,655,392 A | | 8/1997 | Holmgren | 70/57.1 |
| 5,760,689 A | | 6/1998 | Holmgren | 340/568 |
| 5,791,079 A | * | 8/1998 | Mazzucchelli | 40/625 |
| 5,949,339 A | * | 9/1999 | Ettinger et al. | 70/57.1 X |
| 5,969,613 A | * | 10/1999 | Yeager et al. | 340/572.9 |
| 6,050,622 A | * | 4/2000 | Gustafson | 70/57.1 X |
| 6,052,876 A | * | 4/2000 | Hogan et al. | 24/704.1 |
| 6,128,932 A | * | 10/2000 | Mainetti | 70/57.1 |
| 6,226,839 B1 | * | 5/2001 | Sayegh | 70/57.1 X |
| 6,276,033 B1 | * | 8/2001 | Johnson et al. | 24/704.1 |
| 6,279,358 B1 | * | 8/2001 | Costa | 70/57.1 |

FOREIGN PATENT DOCUMENTS

| | | |
|---|---|---|
| EP | 0 225 255 | 6/1987 |
| EP | 0 425 515 | 5/1991 |
| EP | 0 498 693 | 8/1992 |
| FR | 2 729 490 | 7/1996 |

* cited by examiner

*Primary Examiner*—Suzanne Dino Barrett
(74) *Attorney, Agent, or Firm*—Merchant & Gould, P.C.

(57) ABSTRACT

Anti-theft device for spectacle frames comprising a housing (10) forming an opening (18) to receive therein one bow (34) of the spectacle frame. By clamping means (26) in the housing this can be fastened to the bow. The clamping means has a rotatable operating member, which is accessible in a socket (14) provided on the housing, and can be actuated only by using a special tool. The housing is dimensioned to allow, when fastened to the bow, that the spectacle frame is tried on and that the bow is folded. It is divided into two parts in a plane through the socket. A washer (23) provided with an alarm element for affecting a magnetic, acoustic or electromagnetic field, is pushed onto the socket receiving said socket in an opening in the washer for keeping the two parts of the housing together, and is locked against withdrawal from the socket.

8 Claims, 4 Drawing Sheets

ANTI-THEFT DEVICE FOR SPECTACLE FRAMES

The invention relates to an anti-theft device for spectacle frames, comprising a housing which forms an opening to receive therein one bow of the spectacle frame, clamping means in the housing for fastening the housing to the bow, a rotatable operating member for the clamping means, which can be actuated only by using a special tool, the housing being dimensioned to allow, when fastening to the bow, the spectacle frame to be tried on and the bow to be folded, and an alarm element for affecting a magnetic, acoustic, or electromagnetic field.

An anti-theft device of this kind is shown and described in EP-B1-0 425 515. In the embodiments of the anti-theft device described therein the housing comprises an elongated socket to be mounted to the bow in a position projecting substantially perpendicularly therefrom, or in a position along the bow projecting in an oblique angle therefrom. The alarm element is mounted under a cover which is attached to the socket.

The prior art embodiments satisfy well the demands on connected with the anti-theft device, viz. unauthorized removal of the device from the projecting spectacle frame should not be possible and that the device may be left on the spectacle frame at try thereof as far as the majority of spectacle frames is concerned. There is, however, a tremendous variation of spectacle frames and as far as spectacle frames having "high" bows are concerned the anti-theft device cannot be fastened to the bow, and as far as tapering bows are concerned there is a risk that the anti-theft device can be withdrawn from the bow without untied the clamping means having been unified. Although the anti-theft device does not interfere with the try it may be an obstacle when exposing the spectacle frame in certain types of exposure racks, which limits the possibility of choosing a desired type of exposure.

The purpose of the invention is to provide an anti-theft device of the kind referred to above which overcomes said drawbacks and moreover can be manufactured in a simple way and therefore cheaper than the embodiments described in EP-B1-0 425 415.

For said purpose the anti-theft device according to the invention has been given the characterizing features of claim 1.

Figure 1:
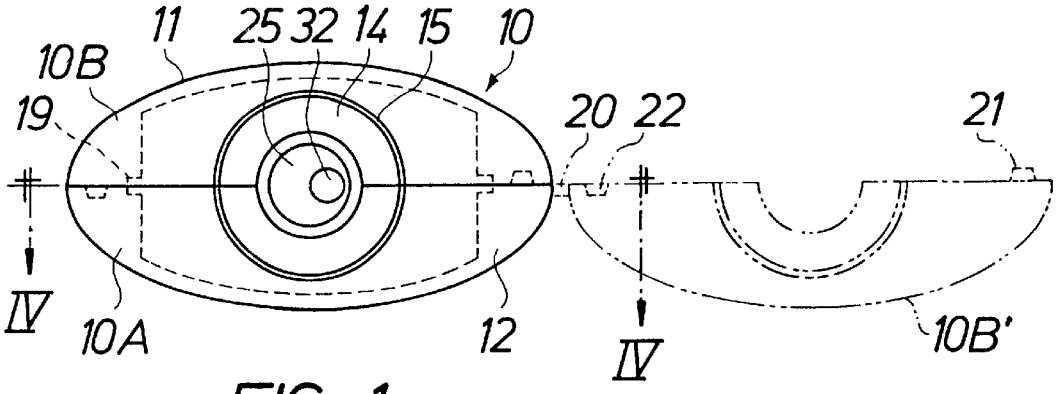
Figure 2:
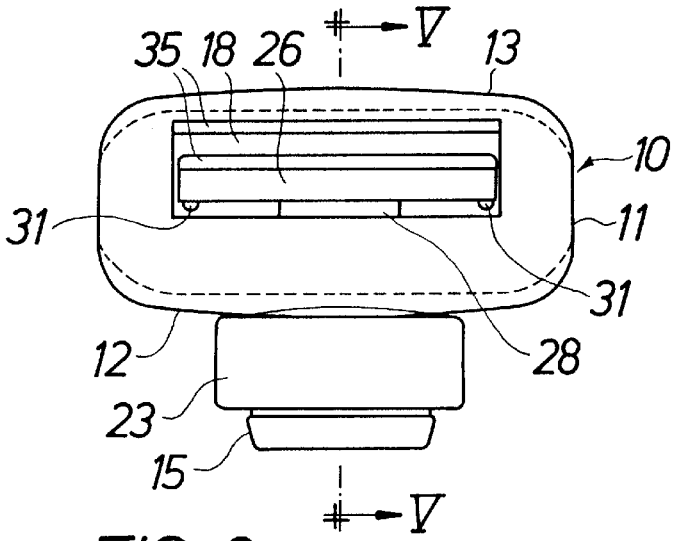
Figure 3:
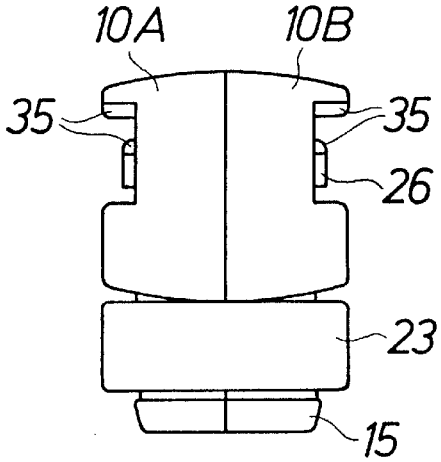
Figure 4:
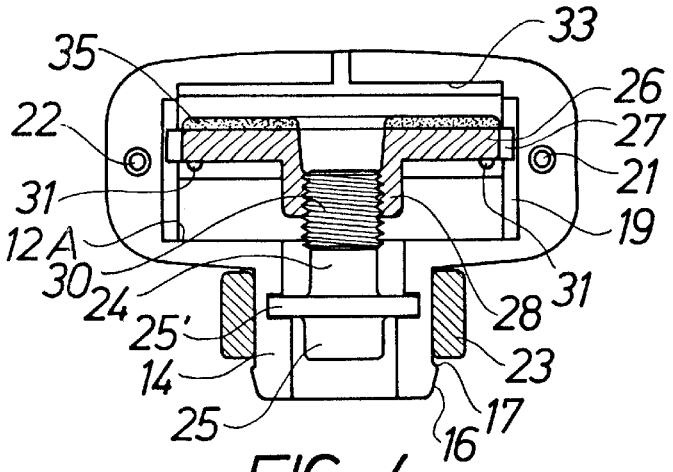
Figure 5:
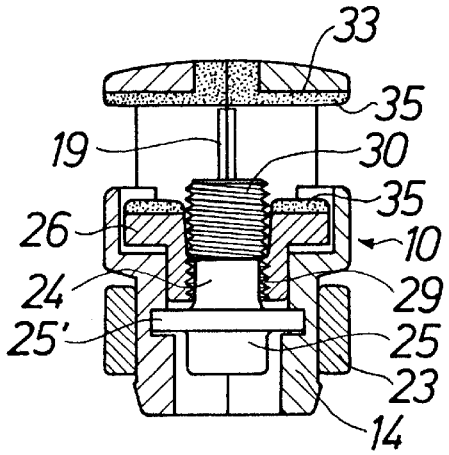
Figure 6:
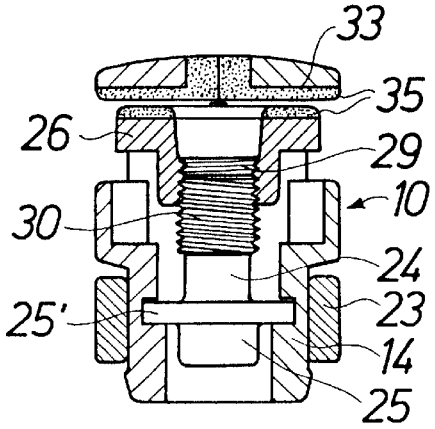
Figure 7:
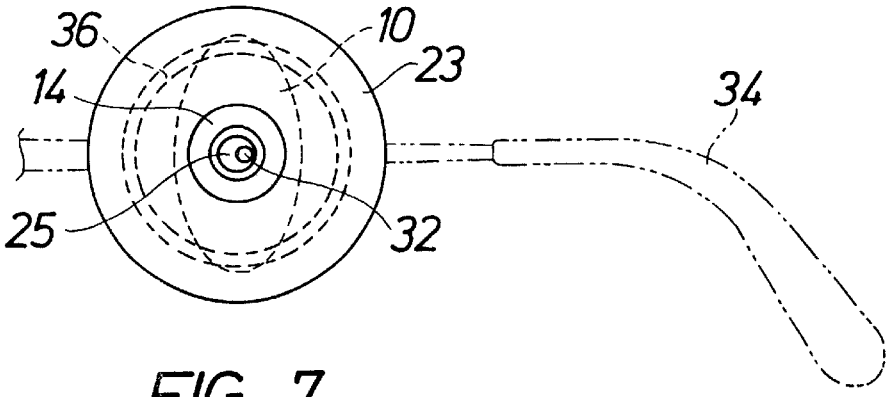
Figure 8:
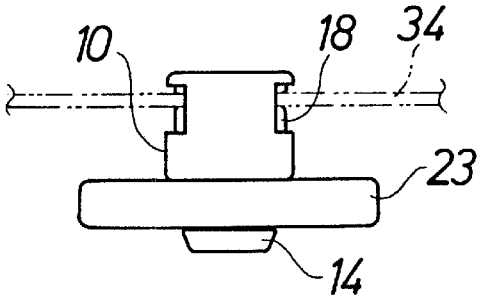
Figure 9:
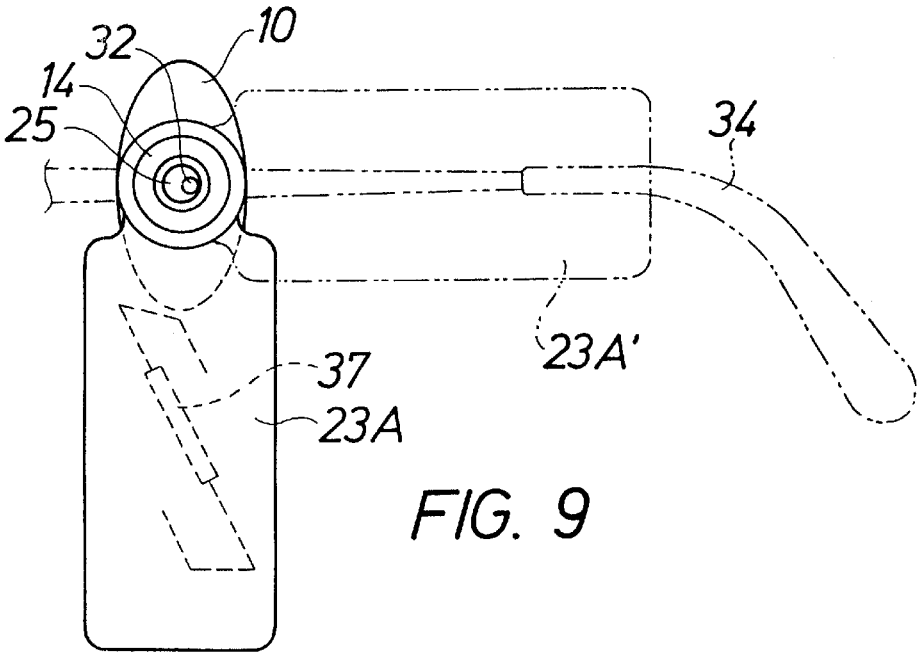
Figure 10:
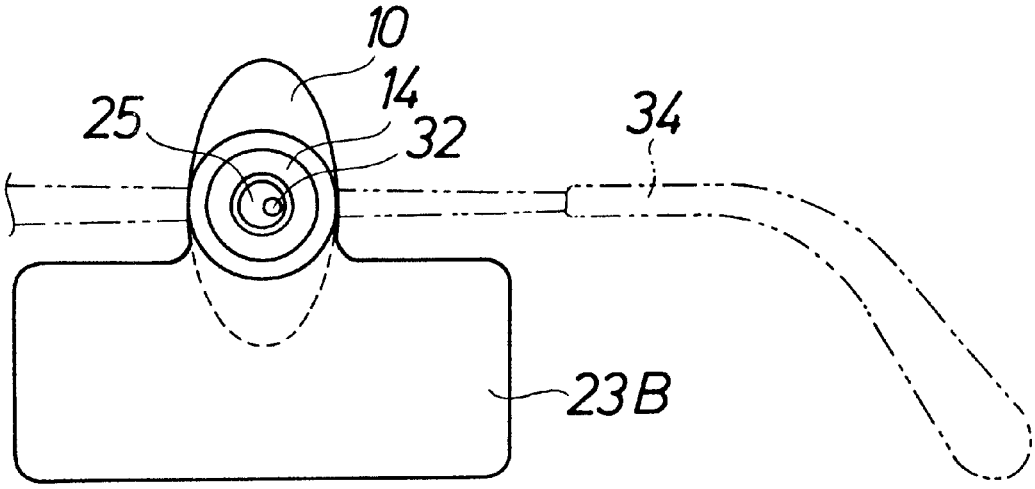

In order to more clearly explain the invention it will be described below with reference to the accompanying drawings in which FIG. 1 is an end view of the housing forming part of the anti-theft device, as seen from the side where the operating member for the clamping means is accessible to be manipulated by means of a special tool, FIG. 2 is a plan view of the anti-theft device, FIG. 3 is a side view of the anti-theft device, FIG. 4 is a cross-sectional view taken along line IV—IV in FIG. 1, FIG. 5 is a cross-sectional view taken along line V—V in FIG. 2 and discloses the anti-theft device in an opened position, FIG. 6 is a corresponding cross-sectional view as FIG. 5 but discloses the anti-theft device in a closed position, FIG. 7 is an end view and FIG. 8 a plan view of the anti-theft device mounted on a bow which is partly indicated by dot-and-dash lines, and discloses an embodiment of the washer for the alarm element, forming part of the anti-theft device, and FIGS. 9 and 10 are corresponding side views as in FIG. 7 but disclose two other embodiments of the washer.

With reference to FIGS. 1–6 the anti-theft device shown in the drawings comprises a housing 10 which preferably consists of plastics, for example poly carbonate, and this housing has an elliptic curved surface 11 and two end surfaces 12 and 13. However, the housing can have any other suitable shape. A cylindrical socket 14 having a circumferential end bead 15 projects from end surface 12 said end bead 15 defining an oblique flank 16 which faces the free end of the socket, and a shoulder surface 17 perpendicular to the socket. Housing 10 forms a rectangular opening 18 extending transversely through the housing in parallel with end surfaces 12 and 13 and forms two diametrically opposite axial grooves 19.

Housing 10 is divided into two identical halves 10*a* and lob in a symmetry plane extending along the major axis of the elliptic curved surface, and in FIG. 1 such a half is indicated by dot-and-dash lines 10B'. At the manufacture of the housing the two halves can be injection moulded as two individual elements but they can also be injection moulded integral with each other at a web 20 so that the half indicated by dot-and-dash lines 103' in FIG. 1 is folded onto the lower half 10*a* indicated by solid lines, in order to complete the housing. Each half has a guide pin 21 and a matching recess 22, which interengage when the two halves are put together. It should be noted, however, that the two halves must not necessarily be symmetric or identical.

In order to keep the two halves of the housing 10 together a washer 23 at an opening therein is pushed onto socket 14 and is located inwardly of the annular bead 15 the washer having such a thickness that it can be received between the bead 15 and the end surface 12. The oblique flank 16 allows the washer to be pushed by a reasonable force over the annular bead to the intended position between the annular bead and the end surface 12 while the shoulder surface 17 on the contrary prevents withdrawal of the washer from the socket. The halves 10A and 10B can be kept together solely by means of washer 23 but additionally the halves can be attached to each other by welding, riveting, snap action, or in another way.

A screw 24 having a flat head 25 is rotatably mounted and axially retained in socket 14 by an annular flange 25' on the head being rotatably received in an inside annular groove in the socket. A rectangular clamp plate 26 is guided at edge projections 27 in grooves 19 and forms a sleeve 28. A through bore extends through the clamp plate and the sleeve, which receives the screw and over a portion of the length thereof has an inside screw thread 29 adjacent the free end of the sleeve while screw 24 has an outside screw thread 30 over a portion of the length thereof about half the length—adjacent the end of the screw opposite to the head. The threads of the bore and the screw are lefthanded. Clamp plate 26 can be engaged with a bounding surface 12A of the housing at wart-like projections 31 on the lower side of the plate. When screw 24 is rotated to the left the clamp plate 26 is displaced to the open position according to FIG. 5 and finally is engaged with the bounding surface 12A of the housing at the wart-like projections 31. Then the screw can be rotated further to the left in order to disengage the thread in the bore, the clamp plate yielding elastically slightly towards said bounding surface so that the inner end of the screw thread 29 in the bore will be held against the inner, end of the screw thread 30 of the screw. At continuous rotation of the screw to the left the clamp plate is disengaged from the screw which then will be idling.

A bore 32 is provided in head 25 said bore being located excentrically on the head adjacent the center thereof. The distance to the center can be of the order of 0.8 mm. In order to rotate the screw a special tool is required which can be introduced into socket 14 to engage bore 32 and can be designed for manual or motor operation. Since head 25 cannot be reached by pliers or the like and a great torque is required in order to rotate the screw by means of a pin or the like inserted into bore 32, due to the short crank represented by the distance between the bore and the center of head 25 the screw cannot be manipulated otherwise than by means of the special tool.

When screw 24 is rotated to the right the screw thread 30 of the screw will engage the screw thread 29 in the bore under the pressure exerted by the elastically depressed clamp plate against the end of the screw thread so that the clamp plate 26 will be screwed against the opposite bounding surface 33 in opening 18 and can be clamped against this surface in the closed position according to FIG. 6.

When the anti-theft device described is applied to a spectacle frame one bow which is indicated by dot-and-dash lines 34 in FIGS. 7 and 8 is passed through opening 18 with the anti-theft device in the open position according to FIG. 5. Clamp plate 26 then is moved to the closed position by rotating the screw 24 to the right, i.e. clockwise as seen in FIGS. 1 and 7, by means of the special tool the clamp plate being engaged with the bow so that this is clamped between the clamp plate 26 and the opposite bounding surface 33 of the housing. The screw is tightened so heavily manually or by motor that the housing will be securely fastened to the bow, and in order that the bow will not be damaged and the frictional engagement between the housing and the bow will be increased clamp plate 26 and the opposite bounding surface 33 of the housing, respectively, are covered by a suitable friction material 35, e.g. rubber. In order that the screw cannot be tightened so heavily that the anti-theft device will be broken or the bow will be damaged there can be provided in the handle of the special tool operated manually or in the drive means of a motor driven special tool a torque sensor limiting the torque that can be transferred from the tool to the screw.

When the anti-theft device is loosened from the bow by rotating screw 24 to the left, i.e. counter-clock-wise as seen in FIGS. 1 and 7, the torque is limited in the fully opened position of the anti-theft device by the disengagement function built into the anti-theft device so that the clamp plate cannot be tightened too heavily against the housing.

The washer 23 in FIGS. 7 and 8 is intended for mounting an alarm element for affecting an electromagnetic field, constructed as a coil 36, and therefore the washer is made circular. The coil should be arranged such that it cannot be removed from the washer. It can be molded into the washer or be located between two circulate plates engaging each other and possibly interconnected said plates forming the washer. When the washer thus constructed is positioned on the socket the two plates can be held pressed against each other between the annular bead 15 and the end surface 12 due to the fact that the distance of the annular bead to the outside bounding surface of the housing substantially equals the thickness of the mounted washer so that the plates cannot be separated even if they are not attached to each other, in order to reach the alarm element which can be attached to the inside surface of one plate. It is not necessary that the plates are identical, and if they are attached to each other the attachment can be made by welding, riveting, snap action or in another way.

The alarm element can also for fields of another type comprise a so-called diode which is an elongated element, and for mounting such an alarm element the washer can be constructed according to FIG. 9 wherein the diode is designated 37. The washer 23A shown in FIG. 9 is rectangular and is mounted to one short side of the housing. The washer can be directed downwards from the bow 34 as indicated by solid lines, but it can as well be directed along the bow as indicated by dot-and-dash lines depending on which position is most suitable for exposing the spectacle frame in a exposure rack.

In FIG. 10 there is shown another washer 23B which is rectangular but is mounted to the housing at the centre of one long side thereof.

In the embodiments according to FIGS. 9 and 10 two plates forming together the washer and enclosing the alarm element can be but are not necessarily attached to each other. Preferably, the plates are made in one piece at the short side or the long side, respectively, which is opposite to the side where the washer is mounted on socket 14, and are folded together to enclose the alarm element and are kept in the folded position by mounting the washer on the socket.

It is possible to form the washer in other ways than that shown herein in order to take into account the special shape of the element supported by the washer or for adapting the washer to a particular exposure rack wherein the spectacle frame protected by the anti-theft device shall be exposed, or in consideration of other aspects.

It would be clear from the description above that the anti-theft device according to the invention is of a very simple construction because it consists of few simple elements which can easily be attached to each other and which are kept together in a simple manner solely by the washer 23 being pushed onto socket 14 and can be removed therefrom only by great trouble and by using a tool. The anti-theft device can easily be applied to bows of different types and is securely maintained in the intended position. A further advantage is that housing 10 can be given small dimensions since no space for the alarm element is required therein.

What is claimed is:

1. Anti-theft device for spectacle frames, comprising:

a housing defining an opening therethrough that receives therein a bow of the spectacle frame;

clamping means in the housing that fasten the housing to the bow;

a rotatable operating member for operating the clamping means, the operating member being actuatable only with a special tool, the housing being dimensioned such that the spectacle frame may be tried on and the bow may be folded while the housing is fastened to the bow; and an alarm element that affects a magnetic, acoustic, or electromagnetic field; wherein:

the housing comprises a projecting socket with the operating member disposed therein and accessible for operation with the special tool;

the housing comprises two parts defined by a plane extending through the socket;

the alarm element comprises a washer that keeps the two parts together, the washer defining an opening therein, the washer being disposed on the socket so as to receive the socket into the opening, the washer being locked against withdrawal from the socket.

2. Anti-theft device according to claim 1, wherein the two parts of the housing are identical.

3. Anti-theft device according to claim 1, further comprising an annular bead disposed on the socket that locks the washer on the socket by snap action.

4. Anti-theft device according to claim 3, wherein the housing comprises an outside bounding surface, and a distance between the annular bead and the outside bounding surface of the housing is substantially equal to a thickness of the washer.

5. Anti-theft device according to claim 4, wherein the washer comprises two plates that receive the alarm element therebetween, the plates being pressed against each other between the annular bead and the outside bounding surface of the housing.

6. Anti-theft device according to any of claim 1, wherein the operating member comprises a screw, and the clamping means comprises a clamping plate displaceable within the housing, the screw engaging the clamping plate with the bow to press the bow against the bounding surface of the housing when the housing is fastened to the bow.

7. Anti-theft device according to claim 6, wherein when the screw is rotated to displace the clamp plate out of engagement with the bow, the screw can be screwed completely out of the clamp plate.

8. Anti-theft device according to claim 7, wherein the clamp plate is pressed elastically against the screw when the screw is completely screwed out of the clamp plate.

* * * * *

UNITED STATES PATENT AND TRADEMARK OFFICE

CERTIFICATE OF CORRECTION

PATENT NO. : 6,374,647 B1
DATED : April 23, 2002
INVENTOR(S) : Holmgren

It is certified that error appears in the above-identified patent and that said Letters Patent is hereby corrected as shown below:

Title page,
Item [73], Assignee, "MW Trading APX" should read -- MW Trading APS --

Signed and Sealed this

Twelfth Day of November, 2002

*Attest:*

*Attesting Officer*

JAMES E. ROGAN
*Director of the United States Patent and Trademark Office*